US008915661B2

(12) United States Patent
Miranda et al.

(10) Patent No.: US 8,915,661 B2
(45) Date of Patent: Dec. 23, 2014

(54) MEDIA DRIVE RESTRAINT

(75) Inventors: Mark G Miranda, Vancouver, WA (US); Keith Janabka, Portland, OR (US); Robert Winburne, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1077 days.

(21) Appl. No.: 12/766,308

(22) Filed: Apr. 23, 2010

(65) Prior Publication Data

US 2011/0262204 A1 Oct. 27, 2011

(51) Int. Cl.

| | |
|---|---|
| ***B41J 29/12*** | (2006.01) |
| ***B41J 29/02*** | (2006.01) |
| ***B41J 13/10*** | (2006.01) |
| ***B41J 29/13*** | (2006.01) |
| ***B41J 29/38*** | (2006.01) |

(52) U.S. Cl.

CPC ..... *B41J 29/02* (2013.01); *B41J 13/106* (2013.01); *B41J 29/13* (2013.01); *B41J 29/38* (2013.01)

USPC ..... 400/691; 400/693

(58) Field of Classification Search

USPC ..... 400/691

See application file for complete search history.

(56) References Cited

U.S. PATENT DOCUMENTS

| | | | | |
|---|---|---|---|---|
| 5,765,825 | A * | 6/1998 | Watase | 271/9.13 |
| 6,072,585 | A * | 6/2000 | Dutton et al. | 358/1.12 |
| 6,371,478 | B1 * | 4/2002 | Jewell | 271/124 |
| 6,621,066 | B2 * | 9/2003 | Kim | 250/221 |
| 7,036,813 | B2 * | 5/2006 | Asada | 271/117 |
| 7,070,350 | B2 * | 7/2006 | Inokuchi et al. | 400/680 |
| 7,515,849 | B2 * | 4/2009 | Iketani | 399/124 |
| 7,905,482 | B2 * | 3/2011 | Matsumoto | 271/213 |
| 7,976,020 | B2 * | 7/2011 | Awai | 271/213 |
| 2005/0287852 | A1 * | 12/2005 | Sugawara et al. | 439/135 |
| 2006/0127149 | A1 * | 6/2006 | Togashi et al. | 399/392 |

* cited by examiner

*Primary Examiner* — Anthony Nguyen

(74) *Attorney, Agent, or Firm* — Steven R. Ormiston

(57) ABSTRACT

In one embodiment, a device for a printer includes a movable tray for supporting a print media. The tray is movable between an open position in which media may be moved on to the tray and a closed position in which media is blocked from moving on to the tray. The device also includes a rotatable media drive component for moving print media on to the tray and a movable restraint operatively connected to the tray. The restraint is movable between: a first position, corresponding to the open position of the tray, in which the restraint does not restrain the media drive component; and a second position, corresponding to the closed position of the tray, in which the restraint restrains rotation of the media drive component.

11 Claims, 8 Drawing Sheets

MEDIA DRIVE RESTRAINT

BACKGROUND

Some printers use folding media trays to enable a compact product size for shipping and a smaller footprint when not in use. The user must fold out the trays for proper printer operation. For example, the user must clear the media discharge area by folding the output tray out from its closed position. This step may be overlooked by the user on printers where the output tray is positioned separately from the input tray, such as printers with a straight through or "L" shaped media path (e.g., top in, front out). If a print job is attempted with the output tray folded in the closed position, the media will crash into the output tray as it is discharged from the printer, resulting in a media jam.

DESCRIPTION

Embodiments of the present disclosure were developed in an effort to automatically detect when a printer output tray is in the closed position so that the output tray may be opened before printing, and thus avoid the difficulties of running a print job with the output tray closed. Although embodiments will be described with reference to an inkjet printer, the disclosure is not limited to inkjet printers. The example embodiments described below should not be construed to limit the scope of this disclosure, which is defined in the claims that follow the description.

As used in this document: a "controller" means a processor (or processors) and associated memory (or memories) and programming at the printer used to control operative elements of the printer, and may include multiple hardware and programming components and multiple circuit boards; and a "print engine" means a component or group of components used to apply ink or toner or other imaging material to a print media, for example the printhead(s) or ink pen(s) in an inkjet printer and the toner developer and photoconductor in a laser printer.

One example of an inkjet printer in which embodiments of the present disclosure may be implemented will be described with reference to FIG. 1. A shaft restraint used for automatically detecting a closed output tray will then be described with reference to FIGS. 2-8. Other components used to detect a closed output tray are then described with reference to FIG. 9 and a method for detecting a closed output tray described with reference to FIG. 10.

Figure 1:
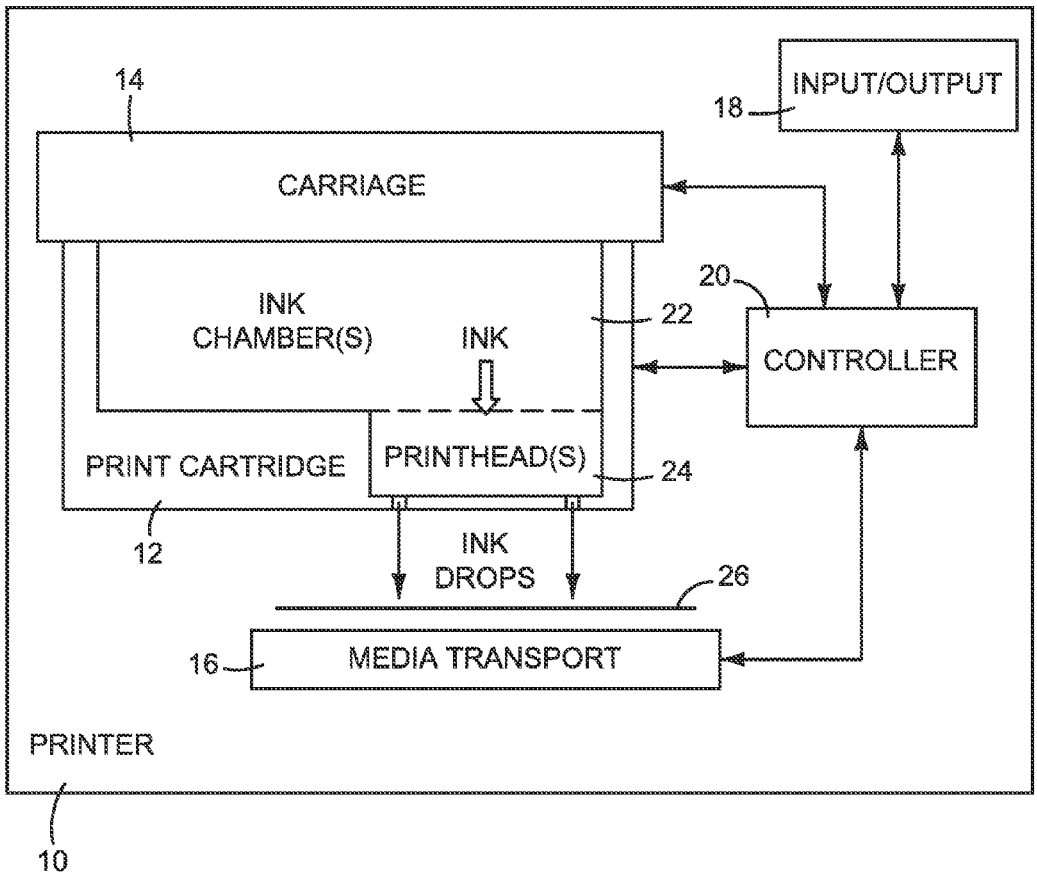
FIG. 1 is a block diagram illustrating one example of an inkjet printer in which embodiments of the present disclosure may be implemented.

Referring first to the block diagram of an inkjet printer 10 in FIG. 1, printer 10 includes a print cartridge 12, a carriage 14, a print media transport mechanism 16, an input/output device 18, and a printer controller 20 connected to each of the operative components of printer 10. Print cartridge 12 includes one or more ink holding chambers 22 and one or more printheads 24. A print cartridge is sometimes also referred to as an ink pen or an ink cartridge. Printhead 24 represents generally a small electromechanical part that contains an array of miniature thermal resistors or piezoelectric devices that are energized to eject small droplets of ink out of an associated array of nozzles. A typical thermal inkjet printhead, for example, includes a nozzle plate arrayed with ink ejection nozzles and firing resistors formed on an integrated circuit chip. Each printhead is electrically connected to printer controller 20 through external electrical contacts. In operation, printer controller 20 selectively energizes the firing resistors through the electrical contacts to eject a drop of ink through a nozzle on to media 22.

Print cartridge 12 may include a series of stationary cartridges or printheads that span the width of print media 26. Alternatively, cartridge 12 may include one or more cartridges that scan back and forth on carriage 14 across the width of media 26. Other cartridge or printhead configurations are possible. A movable carriage 14 may include a holder for cartridge 12, a guide along which the holder moves, a drive motor, and a belt and pulley system that moves the holder along the guide. Media transport 16 advances print media 26 lengthwise past cartridge 12 and printhead 24. For a stationary cartridge 12, media transport 16 may advance media 26 continuously past printhead 12. For a scanning cartridge 12, media transport 16 may advance media 26 incrementally past printhead 24, stopping as each swath is printed and then advancing media 26 for printing the next swath. Controller 20 may communicate with external devices through input/output device 18, including receiving print jobs from a computer or other host device. Controller 20 controls the movement of carriage 14 and media transport 16. By coordinating the relative position of cartridge 12 and printhead 24 with media 26 and the ejection of ink drops, controller 20 produces the desired image on media 26.

Figure 2:
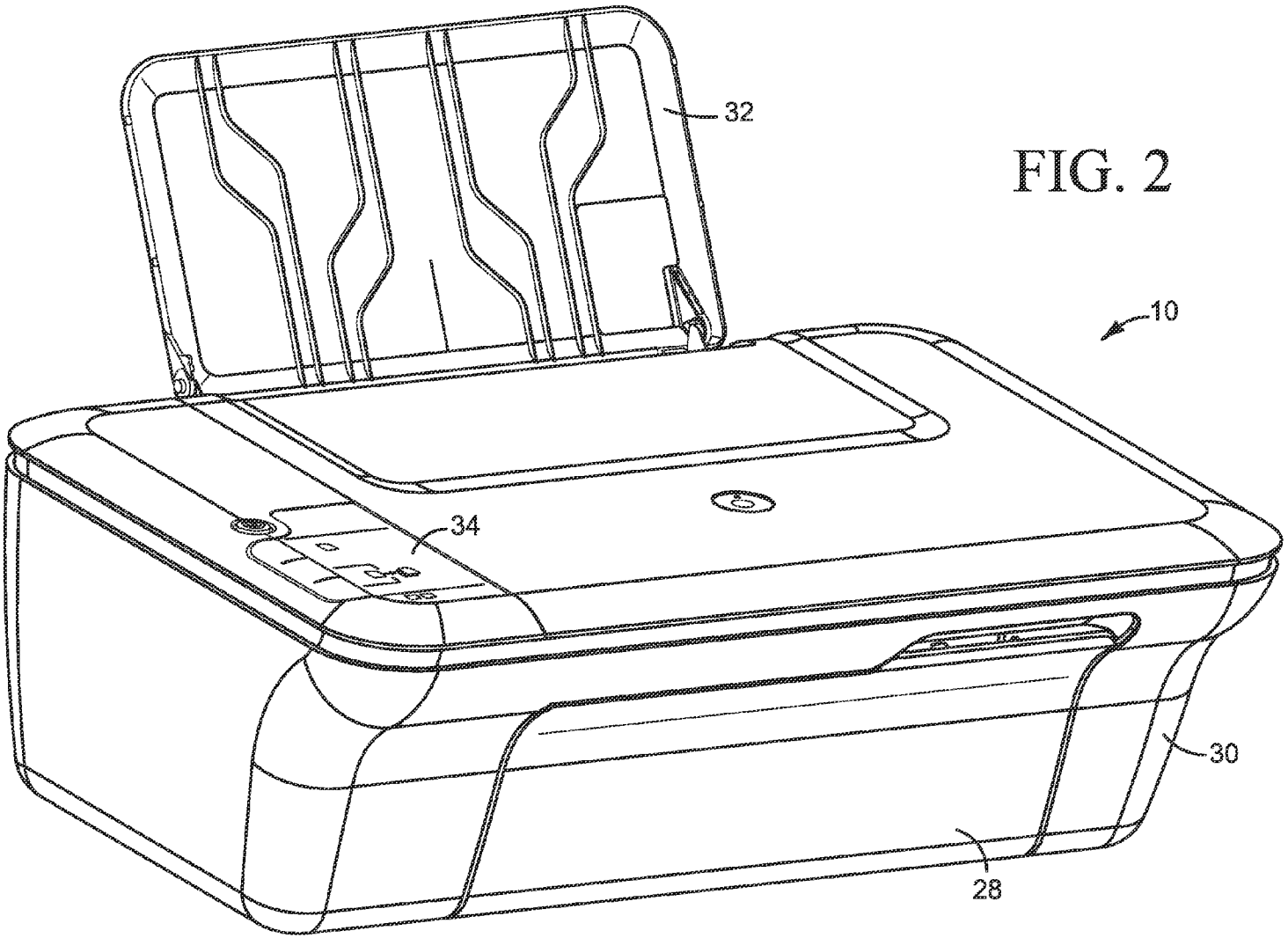
FIGS. 2 and 3 are perspective views illustrating an inkjet printer with a folding media output tray, according to one embodiment of the disclosure. The output tray is folded in to the closed position in FIG. 2 and folded out to the open position in FIG. 3.
Figure 3:
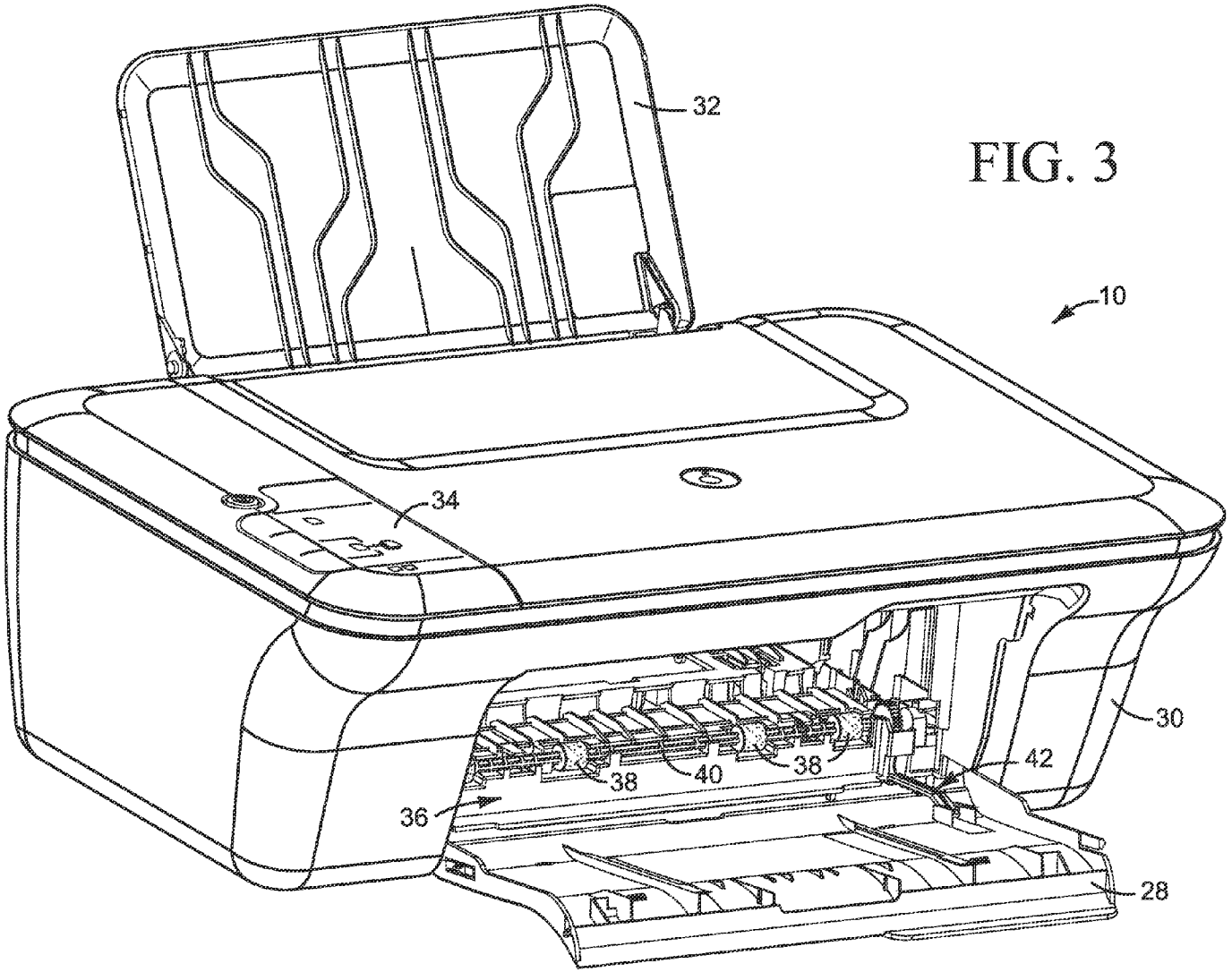

FIGS. 2 and 3 are perspective views illustrating one embodiment of an inkjet printer 10 with a folding media output tray 28. Output tray 28 is folded in to the closed position in FIG. 2 and folded out to the open position in FIG. 3. Referring to FIGS. 2 and 3, in addition to output tray 28, printer 10 includes an external housing 30, a folding input tray 32, and a user control panel 34. A print engine (not shown) and controller (not shown) for printer 10 are housed in housing 30. A print engine for printer 10 may include, for example, a set of print cartridges 12 and a carriage 14 from FIG. 1. A media path 36 extends from input tray 32 to output tray 28. The most downstream part of media path 36 is visible in FIG. 3 where media is discharged to output tray 28 at the urging of rollers 38 mounted along a shaft 40.

Figure 6:
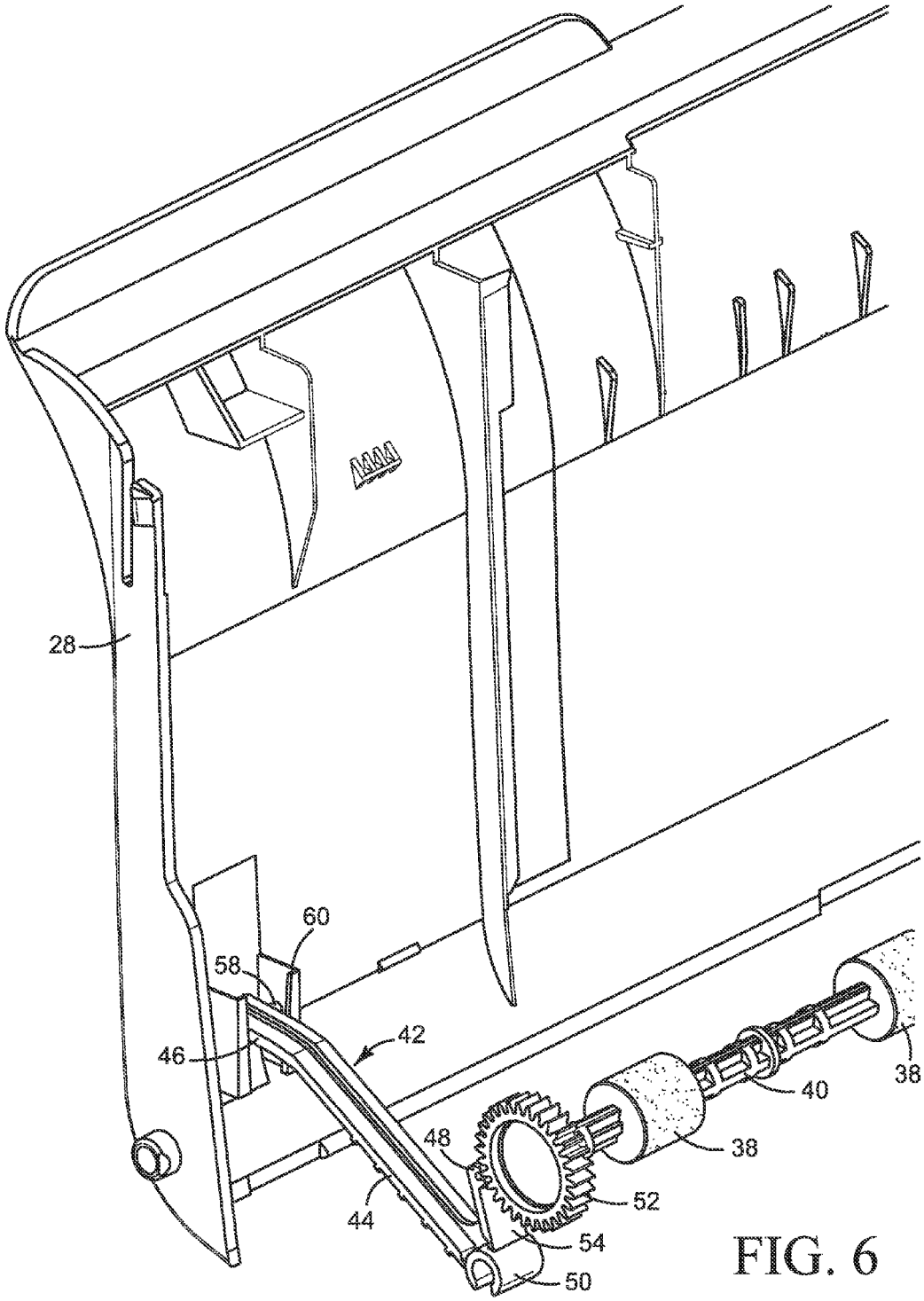
Figure 7:
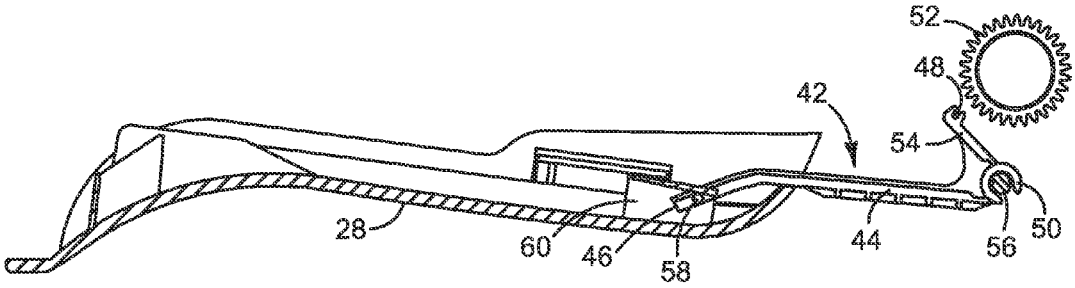
Figure 8:
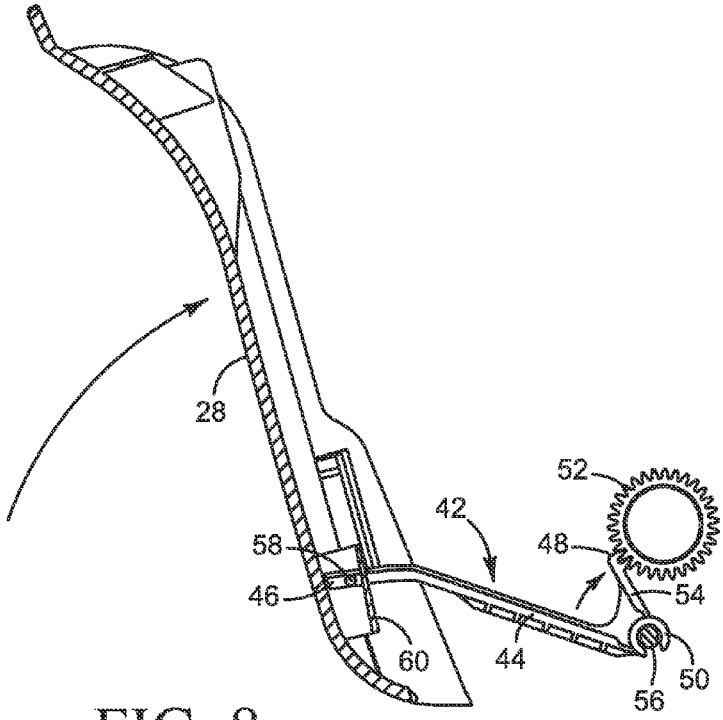

Also visible in FIG. 3 is part of an output roller shaft restraint 42 used for detecting when the output tray 28 is in the closed position. Restraint 42 is shown in detail in FIGS. 4-8. Referring now to FIGS. 4-8, restraint 42 includes an elongated member 44 pinned to output tray 28 at a near end 46 and gear teeth 48 formed at a far end 50 to engage a gear 52 on roller shaft 40. In the embodiment shown, teeth 48 are formed on a short pivot arm 54 projecting from far end 50. Far end 50 is connected to and rotates on a stationary pin 56 (FIGS. 7 and 8). Pin 56 is affixed to or integral with housing 30 or another suitable support within printer 10.

Figure 4:
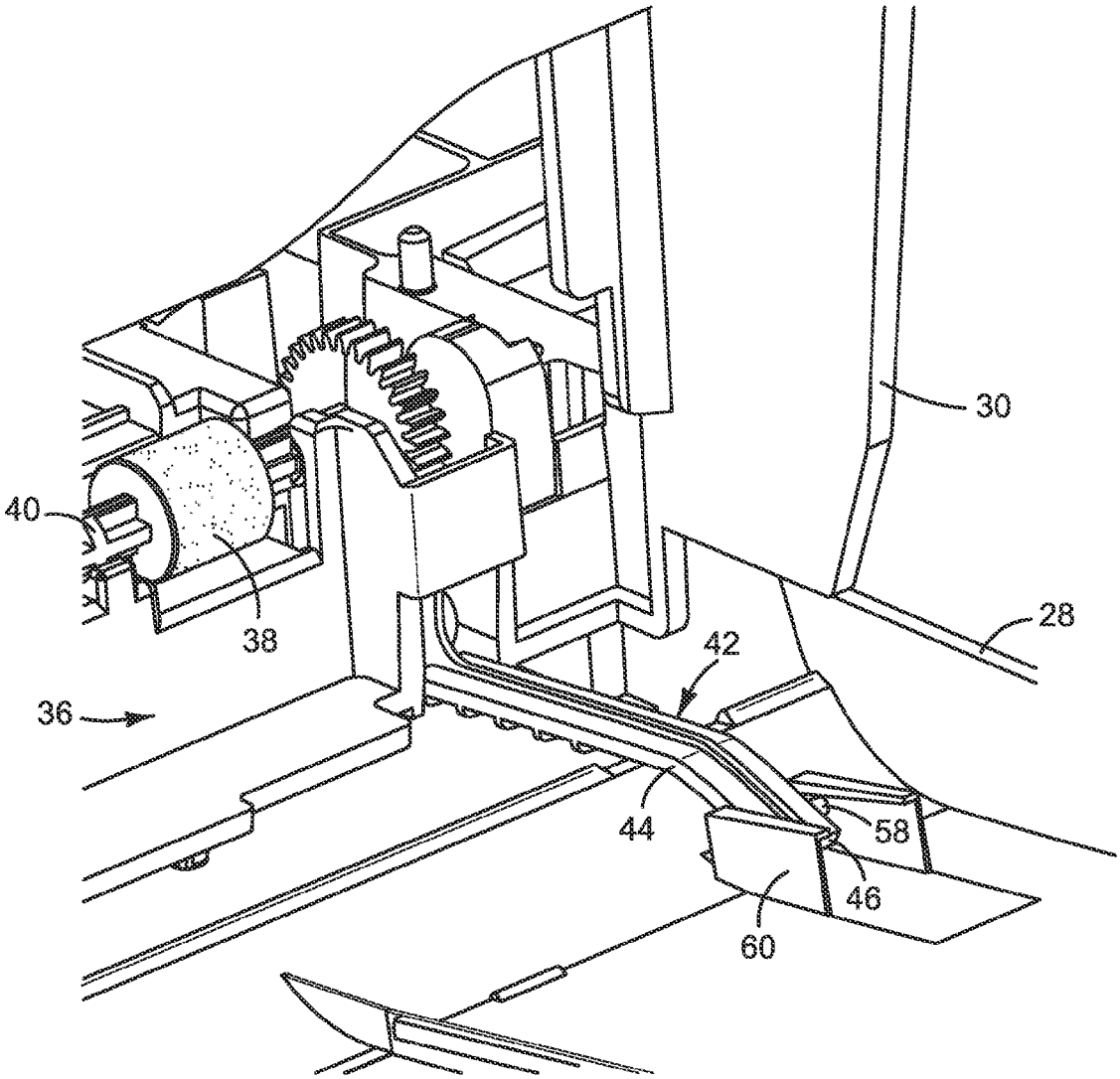
FIGS. 4-8 are detail views from FIGS. 2 and 3 showing one embodiment of a media output roller shaft restraint used for detecting a closed output tray.
Figure 5:
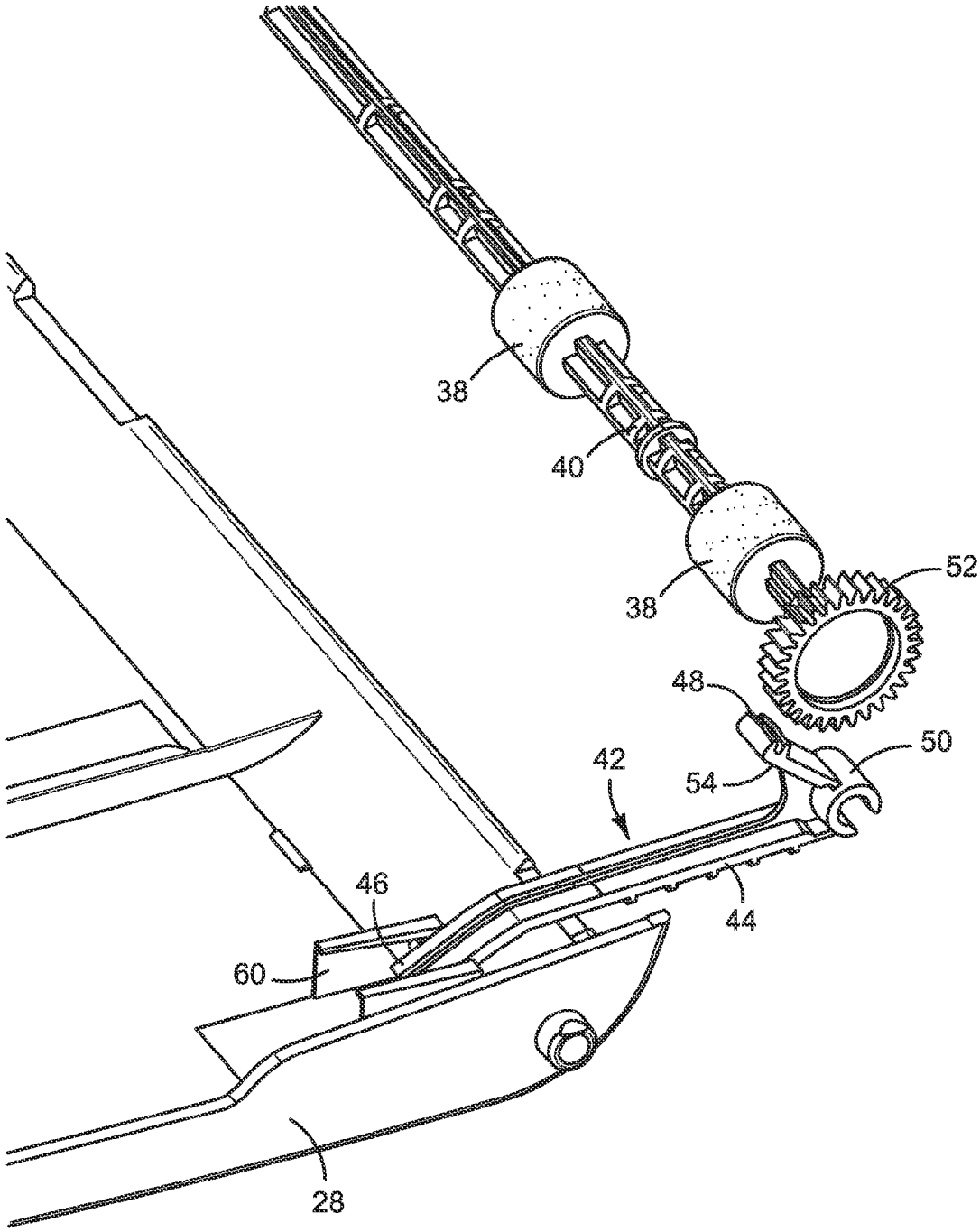

When output tray 28 is open, as shown in FIGS. 4, 5 and 7, restraint teeth 48 are disengaged from roller shaft gear 52. When output tray 28 is closed, as shown in FIGS. 6 and 8, teeth 48 engage gear 52 to restrain rotation of roller shaft 40. As best seen by comparing FIGS. 7 and 8, closing output tray 28 lifts near end 46 of member 44 so that member far end 50 rotates on pin 56 to pivot restraint teeth 48 into engagement with roller shaft gear 52. Thus, output tray 28 functions as the actuator for restraint 42 to engage and disengage gear 52. The near end 46 of member 44 is allowed to pivot on pins 58 in a tray mount 60 as output tray 28 is opened and closed.

Figure 9:
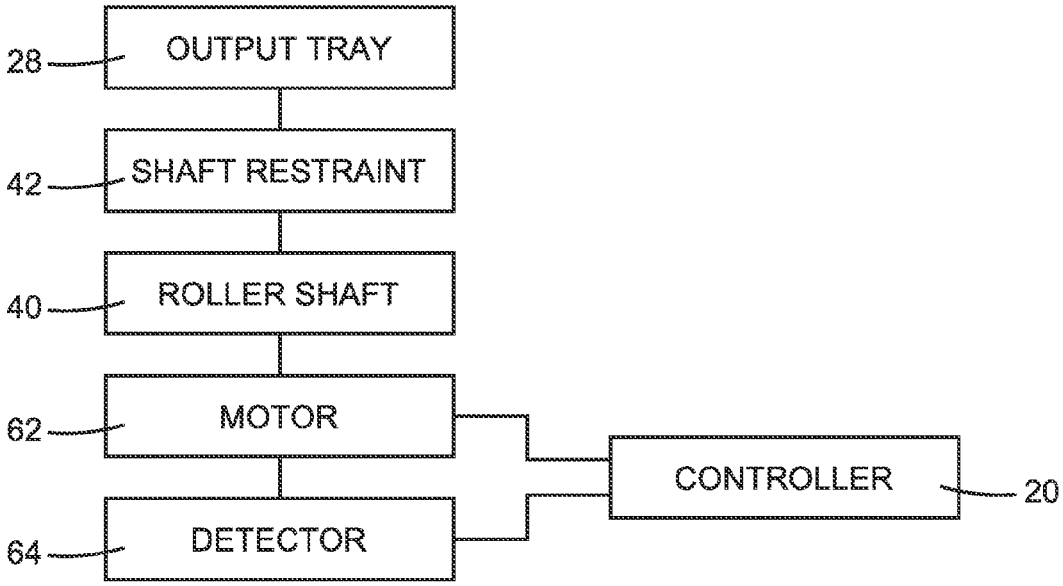
FIG. 9 is a block diagram illustrating components of the printer shown in FIGS. 2 and 3 used for detecting when the output tray is in the closed position, according to one embodiment of the disclosure.

Referring now to the block diagram of FIG. 9, a motor 62 drives roller shaft 40 at the direction of controller 20. A detector 64 detects the electrical power drawn by motor 62. When roller shaft 40 is restrained by restraint 42 as described above, motor 62 will draw more power trying to drive shaft 40. The increased power draw is detected by detector 64 so that controller 20 can alert the user that output tray 28 is closed. Detector 64 may implemented, for example, as part of the servo control firmware (programming) along with circuitry, typically in the motor control ASIC, that measures or senses the power drawn by motor 62. (And, thus, detector 64 may be considered part of controller 20 even though it is shown as a separate block in FIG. 9.) A motor overload limit is set in the servo control firmware to prevent excessive power draw by motor 62. When the power drawn by motor 62 reaches the overload limit, controller 20 shuts down motor 62 to prevent damage to the printer. This shut-down is commonly referred to as motor stall. The general printer firmware determines whether or not the motor stall was caused by a closed output tray 28 based on information about the stalling event (i.e. a so-called stall signature), knowledge of what printer function was being performed or attempted at the time of the stall, and feedback from the media sensor(s). If the motor stall occurred abruptly (e.g., minimal rotation of shaft 40 and a rapid rise in power draw), there was no media in the media path, and the printer function being attempted required a check to be sure output tray 28 was open, then controller 20 determines that restraint 42 is engaged and output tray 28 is closed.

In one example, controller 20 checks during the initial processing of a print job to determine if output tray 28 is closed. Upon receipt of a print job and prior to attempting to feed media from input tray 32, motor 62 is driven forward to rotate output roller shaft 40. If, during this forward move, restraint 42 is engaged and motor 62 is therefore unable to rotate shaft 40, detector 64 will detect that motor 62 is overloaded and controller 20 may determine that output tray 28 is closed—if the printer was initially in an error free, idle state and a pick move has not been initiated, then controller 20 may correctly determine that output tray 28 is closed. A determination that output tray 28 is closed may trigger an alert or message to the user that output tray 28 must be opened prior to continuing the print job. The user may be alerted to the problem through the printer's control panel 34 (FIGS. 2 and 3) and/or through a message sent to a host device. The check for a closed output tray may be repeated at discreet timing intervals after a print job is initiated until there is no longer a determination that output tray 28 is closed.

Figure 10:
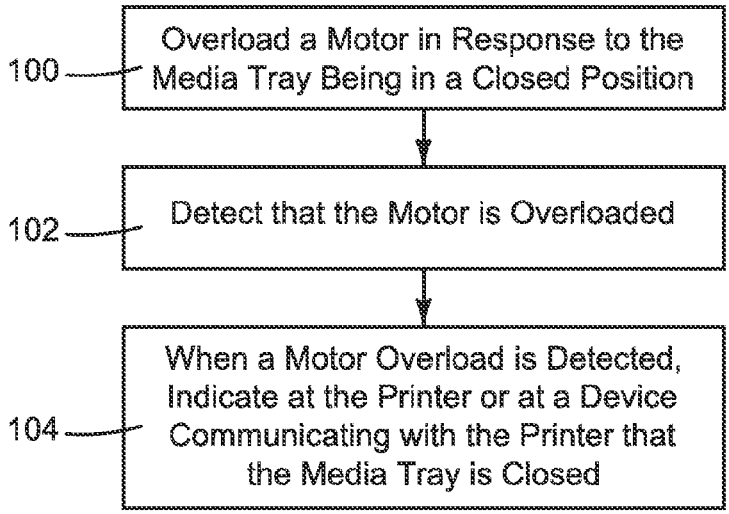
FIG. 10 is a flow chart illustrating one embodiment of a method for detecting a closed printer output tray.

FIG. 10 is a flow chart illustrating one embodiment of a method for detecting a closed printer output tray. Referring to FIG. 10, as indicated at block 100, a printer motor (e.g., motor 62 in FIG. 9) is overloaded in response to the media output tray being in the closed position (e.g., output tray 28 in FIG. 2). As described above, attempting to rotate output roller shaft 40 with restraint 42 engaged will overload motor 62. Thus, in this example, attempting to rotate shaft 40 when output tray 28 is in the closed position overloads motor 62 in response to output tray 28 being in the closed position, in which restraint 42 restrains the rotation of shaft 40. Then, a motor overload is detected at block 102. At block 104, when a motor overload is detected, an indication is given at the printer and/or at a device communicating with the printer that the media tray is closed. For example, a visual and/or audio alert is given at the printer and/or a message sent to the host device.

The embodiments of a media drive restraint and method for automatically detecting a closed media tray described above provide a simple, low cost solution to the problem of running a print job with a closed output tray. Base part 60 supporting member pins 58 on the near end 46 of member 44 may be molded into a plastic output tray 28. Similarly, stationary pin 56 supporting the far end 50 of member 44 may be molded into housing 30. The same gear used to drive roller shaft 40 may be used for gear 52. Thus, restraint 42 may be implemented with the addition of a single new part, member 44, and the method implemented with a comparatively simple modification to the printer firmware (i.e., the programming for controller 20).

As noted at the beginning of this Description, the exemplary embodiments shown in the figures and described above illustrate but do not limit the disclosure. Other forms, details, and embodiments may be made and implemented. Therefore, the foregoing description should not be construed to limit the scope of the disclosure, which is defined in the following claims.

What is claimed is:

1. A device for a printer, comprising:

a movable tray for supporting a print media, the tray movable between an open position in which media is not blocked from moving on to the tray and a closed position in which media is blocked from moving on to the tray;

a rotatable media drive component for moving print media on to the tray; and a movable restraint operatively connected to the tray, the restraint movable between:

a first position, corresponding to the open position of the tray, in which the restraint does not restrain the media drive component; and a second position, corresponding to the closed position of the tray, in which the restraint restrains rotation of the media drive component.

2. The device of claim 1, wherein the rotatable media drive component comprises a shaft and the device further comprises:

a motor for rotating the shaft; and a detector operatively connected to the motor for detecting electrical power drawn by the motor.

3. The device of claim 1, wherein:

the rotatable media drive component comprises a shaft and a gear operatively coupled to the shaft;

the restraint includes teeth; and when the restraint is in the second position, the teeth on the restraint engage the gear to restrain rotation of the shaft.

4. The device of claim 2, the detector measuring or sensing electrical power drawn by the motor and detecting when the electrical power drawn by the motor exceeds a limit.

5. A printer, comprising:

a print engine for printing on a print media;

a movable output tray for supporting print media, the tray movable between an open position in which print media is not blocked from moving on to the tray and a closed position in which print media is blocked from moving on to the tray;

a media path along which print media is moved from the print engine to the output tray;

a shaft having rollers thereon located near the output tray for moving print media along the media path on to the output tray; and a restraint operatively coupled to the output tray, the restraint movable at the urging of the output tray between:

a first position when the output tray is open, in which the restraint does not engage the shaft and the shaft is free to rotate unrestrained by the restraint; and a second position when the output tray is closed, in which the restraint engages the shaft to restrain rotation of the shaft.

6. The printer of claim 5, further comprising:

a controller operatively connected to the print engine;

a motor operatively connected to the shaft and the controller for rotating the shaft at the direction of the controller;

a detector for detecting an amount of electrical power drawn by the motor while rotating the shaft; and the controller configured to determine that the output tray is in the closed position when the amount of power drawn by the motor is detected to be greater than a limit.

7. The printer of claim 6, wherein the controller is further configured to, when the controller determines that the output tray is in the closed position, indicate at the printer or at a device communicating with the printer that the output tray is closed.

8. The printer of claim 6, the detector measuring or sensing electrical power drawn by the motor and detecting when the electrical power drawn by the motor exceeds the limit.

9. The printer of claim 5, further comprising a gear operatively coupled to the shaft and wherein the restraint includes teeth configured to engage the shaft gear to restrain rotation of the shaft when the restraint is in the second position.

10. The printer of claim 9, wherein the restraint comprises:

an elongated member having a near end and a far end, the near end pivotally mounted to the output tray and the far end rotatable about a stationary axis; and a pivot arm projecting from the far end of the elongated member, the teeth disposed on the pivot arm; and wherein closing the output tray lifts the near end of the elongated member to rotate the far end of the elongated member about the stationary axis so that the teeth on the pivot arm rotate to engage the shaft gear, thus moving the restraint from the first position to the second position.

11. The printer of claim 5, wherein the print engine comprises an inkjet print cartridge.

* * * * *

UNITED STATES PATENT AND TRADEMARK OFFICE

CERTIFICATE OF CORRECTION

PATENT NO. : 8,915,661 B2
APPLICATION NO. : 12/766308
DATED : December 23, 2014
INVENTOR(S) : Mark G. Miranda et al.

It is certified that error appears in the above-identified patent and that said Letters Patent is hereby corrected as shown below:

On the Title page, in item (75), Inventors, in column 1, line 2, delete "Keith Janabka" and insert -- Keith Jariabka --, therefor.

Signed and Sealed this
Twenty-third Day of June, 2015

Michelle K. Lee

Michelle K. Lee
*Director of the United States Patent and Trademark Office*